United States Patent [19]

Blanc

[11] Patent Number: 4,847,927

[45] Date of Patent: Jul. 18, 1989

[54] GARBAGE COLLECTION DEVICE FOR A SINK UNIT, IN PARTICULAR, A BUILT-IN SINK UNIT

[75] Inventor: Walter Blanc, Oberderdingen, Fed. Rep. of Germany

[73] Assignee: Blanco GmbH & Co. KG, Fed. Rep. of Germany

[21] Appl. No.: 145,091

[22] Filed: Jan. 19, 1988

[30] Foreign Application Priority Data

Jan. 23, 1987 [DE] Fed. Rep. of Germany ..... 3701893

[51] Int. Cl.[4] ..... E03C 1/00; B07C 5/00

[52] U.S. Cl. ..... 4/629; 209/706; 209/933; 209/942; 312/212; 312/305

[58] Field of Search ..... 209/706, 933, 942; 4/629; 312/211, 212, 305

[56] References Cited

U.S. PATENT DOCUMENTS

| | | | |
|---|---|---|---|
| 1,773,236 | 8/1930 | Moessmer | 193/23 |
| 3,322,273 | 3/1964 | Bailey | 209/933 |
| 4,689,840 | 9/1987 | Mück et al. | 4/629 |

FOREIGN PATENT DOCUMENTS

| | | |
|---|---|---|
| 2115805 | 10/1972 | Fed. Rep. of Germany . |
| 3428606 | 2/1985 | Fed. Rep. of Germany . |
| 2014100 | 4/1970 | France . |
| 2145617 | 4/1985 | United Kingdom . |

OTHER PUBLICATIONS

"Blanco-Spule hilft Umweltprobleme losen," Kuchenforum, p. 9, 1985.

*Primary Examiner*—Henry J. Recla
*Assistant Examiner*—Robert M. Fetsuga
*Attorney, Agent, or Firm*—Leydig, Voit & Mayer

[57] ABSTRACT

Garbage collection device for a built-in sink unit with a garbage discharge opening which is integrated into its top surface and below which a holder is arranged for several waste containers, one of which can be loaded with garbage through the discharge opening. To enable easy sorting of the garbage to be disposed of through the garbage discharge opening, the holder comprises a waste container support in the form of a merry-go-round and an actuating means for the support in order to selectively bring one of several waste containers into the position below the discharge opening.

15 Claims, 4 Drawing Sheets

16
40
14
34
32
102
30
20
130
36
112
92
94
84
60
104
86
100
82
18
46
96
90
88
18
80
98
122
58
66
46
42
124
48
70
4
70
48
54
50
64
44
56
68
62
4
52
52
50
22
24
10

FIG. 4
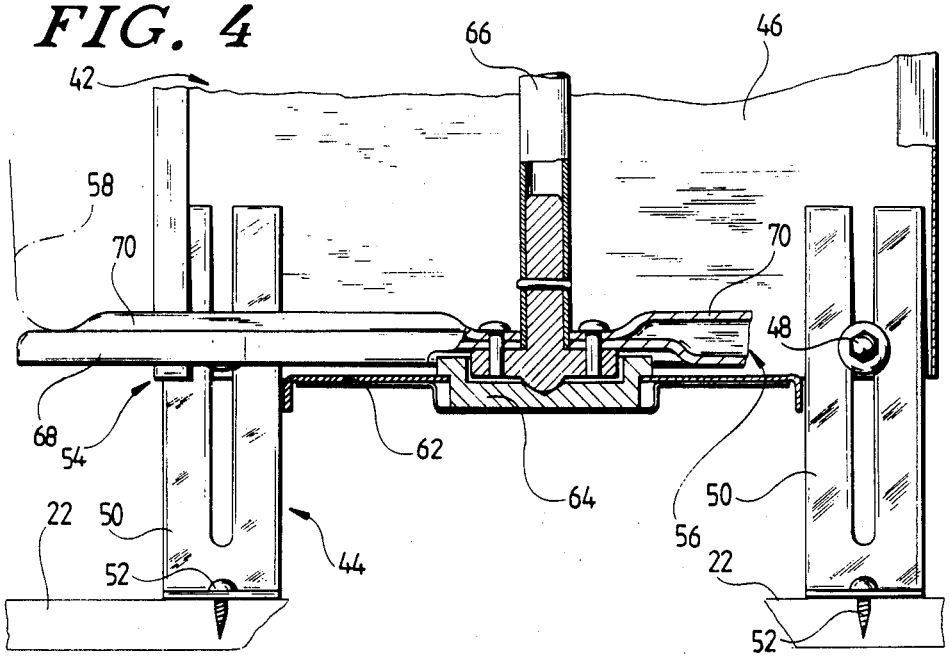
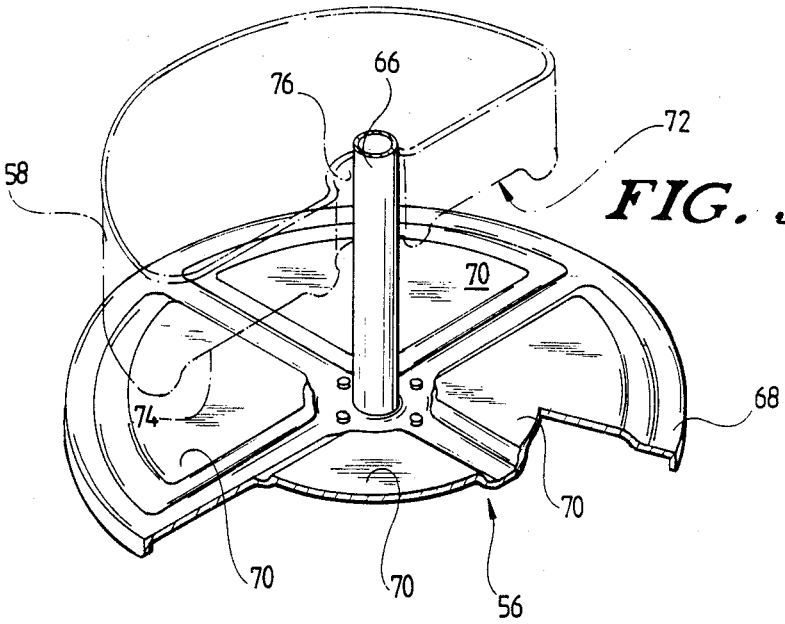
FIG. 5

GARBAGE COLLECTION DEVICE FOR A SINK UNIT, IN PARTICULAR, A BUILT-IN SINK UNIT

The invention relates to a garbage collection device for a sink unit which, in particular, is designed as a built-in sink unit and has a garbage discharge opening integrated into its top surface, comprising a holder which can be mounted below the sink unit for several waste containers which are open at the top and one of which can be loaded with garbage through the discharge opening.

A built-in sink unit combined with such a garbage collection device is known (BLANCOMULTIBOX with MULTIBOX-SET built-in sink unit of the applicant company corresponding to German Patent Application No. P 35 422.4). In this known construction, in which the garbage discharge opening is arranged between a sink and a draining surface of the built-in sink unit in front of a small scraps basin, a garbage chute extends from the discharge opening downwardly to immediately beyond the upper rim of a waste bin which can be pulled frontwards out of a first pair of guide rails attached to the holder. The holder carries two further pairs of guide rails for a second waste bin which can be pulled out frontwards and a cleaning agent basket which hangs between the two waste bins and can similarly be pulled out frontwards. This enables the housewife to deposit organic waste in the first above-mentioned waste bin through the discharge opening and the chute, without having to open the door of a bottom cupboard, whereas inorganic waste such as cans, bottles and the like are to be collected in the second waste bin hanging under the sink. This involves opening the door of the bottom cupboard and pulling the second waste bin at least partly out of the holder towards the front. The holder hangs in the region of the garbage chute on the built-in sink unit and is supported on the outside beside the second waste bin on the floor of the bottom cupboard.

The object underlying the invention is to make separation of the waste, which is becoming increasingly popular, easier for the housewife. To achieve this object, it is proposed that the above-described known garbage device be so designed that the holder comprises such a waste container support which is movable relative to the sink unit and an actuating means for the waste container support that one of at least two waste containers can be selectively positioned below the discharge opening and thus loaded with garbage through it. Accordingly, to load at least two available waste containers it is no longer necessary to first open a bottom cupboard door or the like to make the second waste container accessible for the part of the waste for which it is intended. In this case, it is not a question of the waste containers having to be bins as it is, for example, also possible to hang only waste bags in the support.

In principle, it is conceivable to mount the support in a slidingly displaceable manner, for example, on a frame suspended on the sink unit and/or secured to the floor of the bottom cupboard, thereby to enable the respectively selected waste container to be brought into the position below the garbage discharge opening by sliding displacement of the support. Displacement of the waste container support can be brought about by a motor, but it is also conceivable to carry out the displacement by hand by attaching to the support, for example, an actuating arm which protrudes through a slit in an upper shutter on the front side of the bottom cupboard. However, on account of its low space requirement, an embodiment is preferred in which the support is rotatable about a vertical axis and thereby forms with the waste containers a kind of merry-go-round which enables any one of the waste containers to be selectively brought into the position below the garbage discharge opening. This can be achieved in a particularly simple manner by providing the support with a shaft which defines the vertical axis and which may also be a flexible shaft which is guided upwards through the sink unit or towards the front through the front of the bottom cupboard to as far as a handle of, for example, toggle-type configuration having an associated indicator which indicates which waste container is presently occupying the position below the discharge opening without the door of the bottom cupboard having to be opened.

Since the upper opening of the waste containers is advantageously chosen larger than the garbage discharge opening and different items of garbage form different angles of inclination, one might consider bringing the waste containers intended for different garbage (for example, organic waste, on the one hand, and glass, metal cans and the like, on the other hand) into different receiving positions below the discharge opening. However, the construction with the waste container merry-go-round is made much simpler and, therefore, more advantageous by arranging the waste containers at the same radial distance from the axis of rotation. The different amounts of the various kinds of household garbage can still be taken into account by the waste containers extending over different sized angular segments in the direction of rotation. In a particularly simple and, therefore, inexpensive embodiment of the invention, the waste containers are, however, of identical design and their positions are interchangeable by moving the support. Hence the upper opening of the waste container respectively occupying the receiving position is always identical with respect to shape and position.

With a view to providing as high a degree of operating ease as possible, it is, furthermore, proposed that the construction be of such design that the actuating means comprises a drive for the support and a control system for this drive for selection of a particular waste container, with the control system being so designed that the drive is automatically stopped when the selected waste container occupies the receiving position below the garbage opening. This is readily achievable with cam-operated switches, proximity switches or the like and so the housewife need only give the drive a starting pulse by means of the control system to make the drive bring the next waste container into the receiving position. It is, of course, also conceivable to provide the control system with a selector switch to enable a particular waste container to be selected and brought straight into the position below the garbage discharge opening by the drive.

Since the garbage collection device should, if possible, fit into one of the bottom cupboards of a built-in kitchen with the standard measurement of 60 cm, it may well be that the waste containers cannot be brought into a receiving position in which they lie exactly vertically below the garbage discharge opening. Above all, when more than two waste containers are accommodated in the holder and, consequently, the cross-section of their opening is relatively small, there can be a danger of garbage, drips and the like dropping down through the garbage discharge opening not safely reaching the waste container occupying the receiving position. To eliminate this risk, it is recommendable to take one of the following two measures or a combination of these measures: As is known per se from the technique described at the beginning, a vertical or inclined chute can extend from the garbage opening to a short distance beyond the rim of the waste container respectively occupying the receiving position and it is preferably liftable out of the garbage opening in the upward direction to enable cleaning. Additionally or alternatively, the holder may be provided above the waste container occupying the receiving position with a funnel-shaped conducting device for drips, garbage or the like dropping down through the garbage opening. This ensures, also in the event that the above-mentioned chute was inadvertently omitted after cleaning, that all the matter that drops through the garbage opening does fall into the waste container. If both the chute and the funnel-shaped conducting device are provided, it is recommendable to design the construction in such a way that the chute dips into the funnel-shaped conducting device.

Since the bottom cupboards of built-in kitchens of the various manufacturers are not uniform in height and the vertical spacing between the floor of the bottom cupboard and its top edge is not at all standardized, it is recommendable, above all, if a garbage chute is used, to provide the holder with a vertically adjustable frame for positioning on the floor of a bottom cupboard supporting the sink unit so as to ensure that the chute spans the section from the garbage discharge opening to the waste container occupying the receiving position.

As mentioned previously, it is recommendable to provide an indicator to indicate which waste container is occupying the receiving position. This indicator can function mechanically or electrically.

To enable the funnel-shaped conducting device, parts of the drive and parts of the control system to be expediently accommodated and mounted and to take into account the fact that often one and the same built-in sink unit must be built in two versions of mirror-image design, i.e., with sink on the right and sink on the left, the holder of a particularly advantageous embodiment of the inventive garbage collection device comprises an exchangeable or convertible cover located above the waste containers and having a feed means for the waste container occupying the receiving position.

Above all, if only a starting pulse is required to switch on the drive, it is recommendable for the control system to be provided with an actuating element for switching on the drive and for the actuating element to be integrated into the top surface of the sink unit, and with it the indicator, since, for example, a capacitive proximity switch operated with a finger and an indicator lamp can readily be covered with a glass or plastic plate and thus built into the sink unit in a water-tight manner. In a particularly advantageous embodiment, the actuating element is, therefore, in the form of a switch with an integrated indicator lamp, in which case the switch can also be a kind of push-buttom switch covered with a thick transparent foil or the like.

Further features, advantages and details of the invention are to be found in the following description and the appended drawings of a particularly advantageous embodiment of the inventive garbage collection device. In the drawings:

FIG. 4 is a sectional view along line 4—4 in FIG. 2 through the lower region of the garbage collection device; and FIG. 5 is a perspective illustration of the bottom of the garbage collection device supporting the waste bins, viewed in the direction of line 5—5 in FIG. 3.

Figure 1:
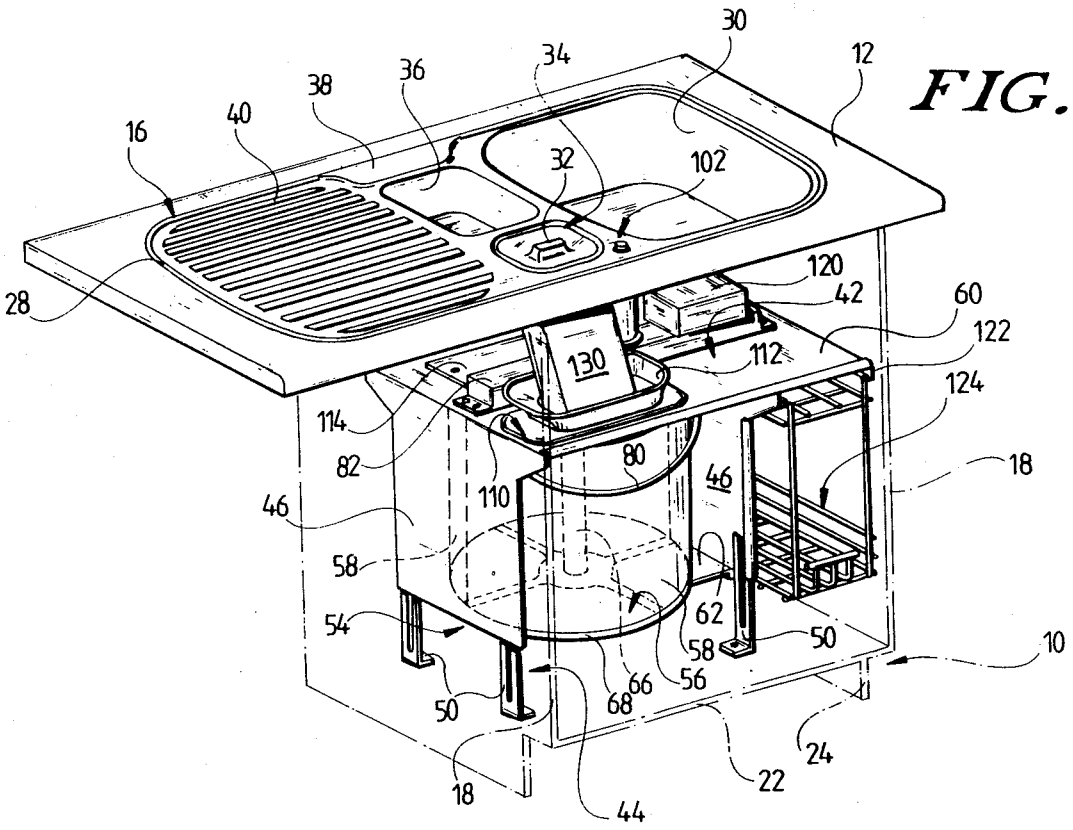
FIG. 1 is a perspective illustration of a built-in sink unit inserted into a counter top with a built-on garbage collection device accommodated in a bottom cupboard indicated in dot-and-dash lines.

The drawings show a counter top 12 which is supported by a bottom cupboard 10 and comprises a cutout section 14 into which a built-in sink unit 16 is inserted from above. The bottom cupboard 10 consists essentially of side walls 18, a rear wall 20, a floor 22 and a base 24 and also of one or several front doors which are not illustrated. The built-in sink unit 16 is designed to include within a circumferential rim 28 a sink 30, a garbage discharge opening 34 closed by a removable cover 32, a scraps basin 36, a base 38 for faucet fittings and a draining surface 40. It may be made of high-grade sheet steel, enamel-coated sheet metal or a plastics material.

The inventive garbage collection device 42 is arranged in the bottom cupboard 10 and has a frame designated in its entirety by 44. The frame stands on the floor 22 of the bottom cupboard by means of frame feet 50 mounted for vertical adjustment and fixed by clamp screws 48 on side walls 46 and is secured to the floor of the bottom cupboard by wooden screws 52. The frame 44 is part of a holder designated in its entirety by 54 for a waste bin support 56 which, as is apparent, for example, from FIGS. 8 and 5, accommodates two waste bins 58 although the illustrated support could also accommodate three or four differently designed waste bins. Further components of the holder 54 are an exchangeable or convertible cover 60 and a bottom 62 which are held by the side walls 46.

Figure 3:
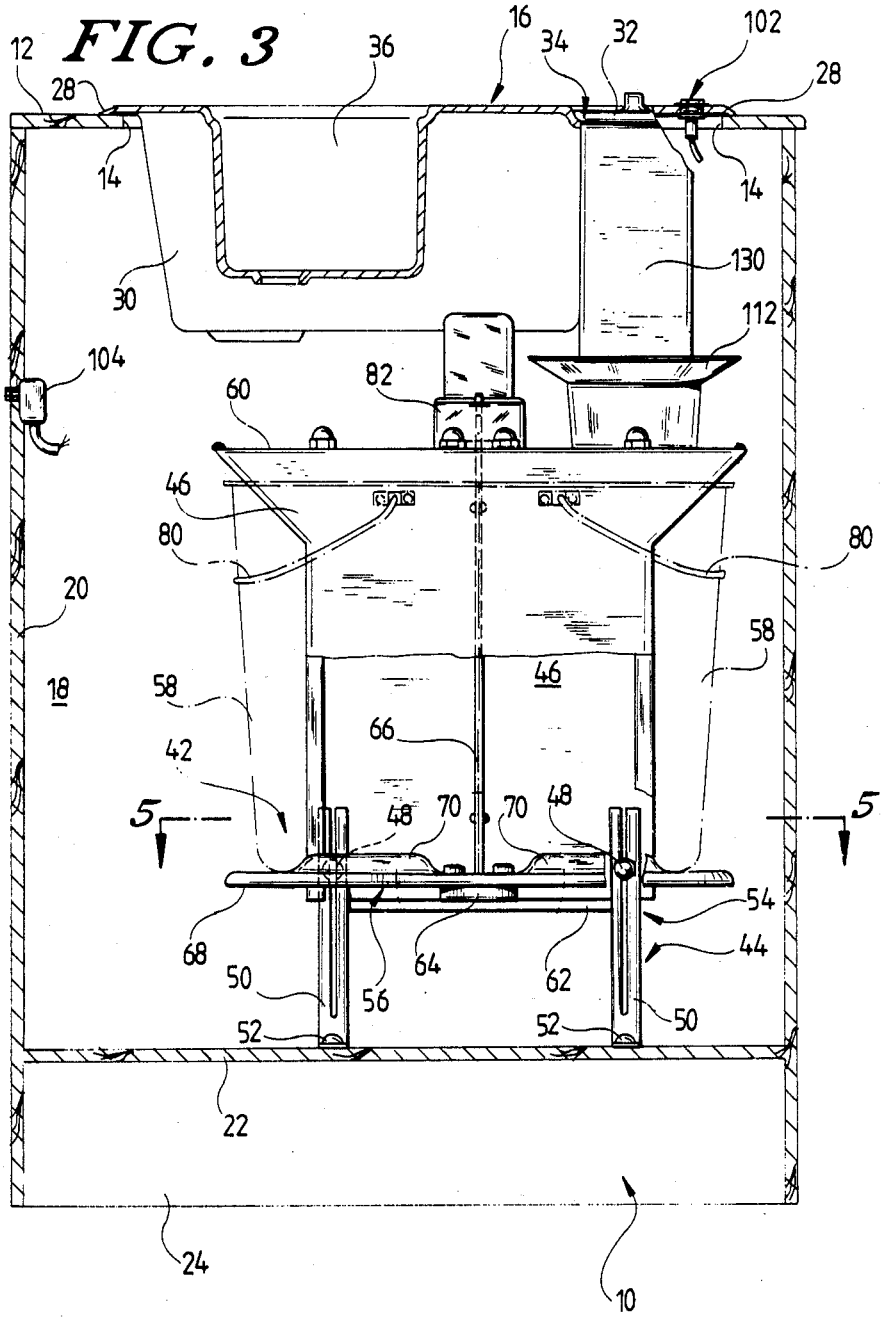
FIG. 3 is a vertical sectional view through the components shown in FIG. 1 perpendicularly to the drawing plane of FIG. 2.

As is apparent from FIGS. 3 and 4, a vertical shaft 66 is supported on the bottom 62 of the holder 54 by means of an axial bearing 64 in the form of a slide bearing. Attached to the shaft and rotatable with it is a bottom 68. In the preferred embodiment, this rotatable bottom 68 is provided with four centering projections 70, each having the shape of a sector of a circle extending over 90 degrees. The bottoms 72 of the waste bins 58 are of corresponding design. Since each of the illustrated waste bins extends over half of the rotatable bottom 68, each waste bin bottom 72 is provided with two recesses 74 having the shape of sectors of a circle, each extending over 90 degrees. The centering projections 70 fit into these recesses in order to prevent the waste bins from slipping on the rotatable bottom 68 when it is accelerated or braked. It is also advantageous for the inside walls of the waste bins 58 to be provided with vertical grooves or recesses 76 of semicircular cross-section to enable the two waste bins to be placed against each another with their inside walls and the shaft 66 to then extend in the channel formed by the two recesses 76. An optimal bin volume is obtained by using the available space in this way. Instead of a waste bin extending over 180 degrees, it is, of course, also possible to use a smaller bin, for example, one which extends over only 90 degrees and has a recess in its bottom into which only one of the centering projections 70 fits. Handles which are swingably attached to the waste bins are designated by 80.

Figure 2:
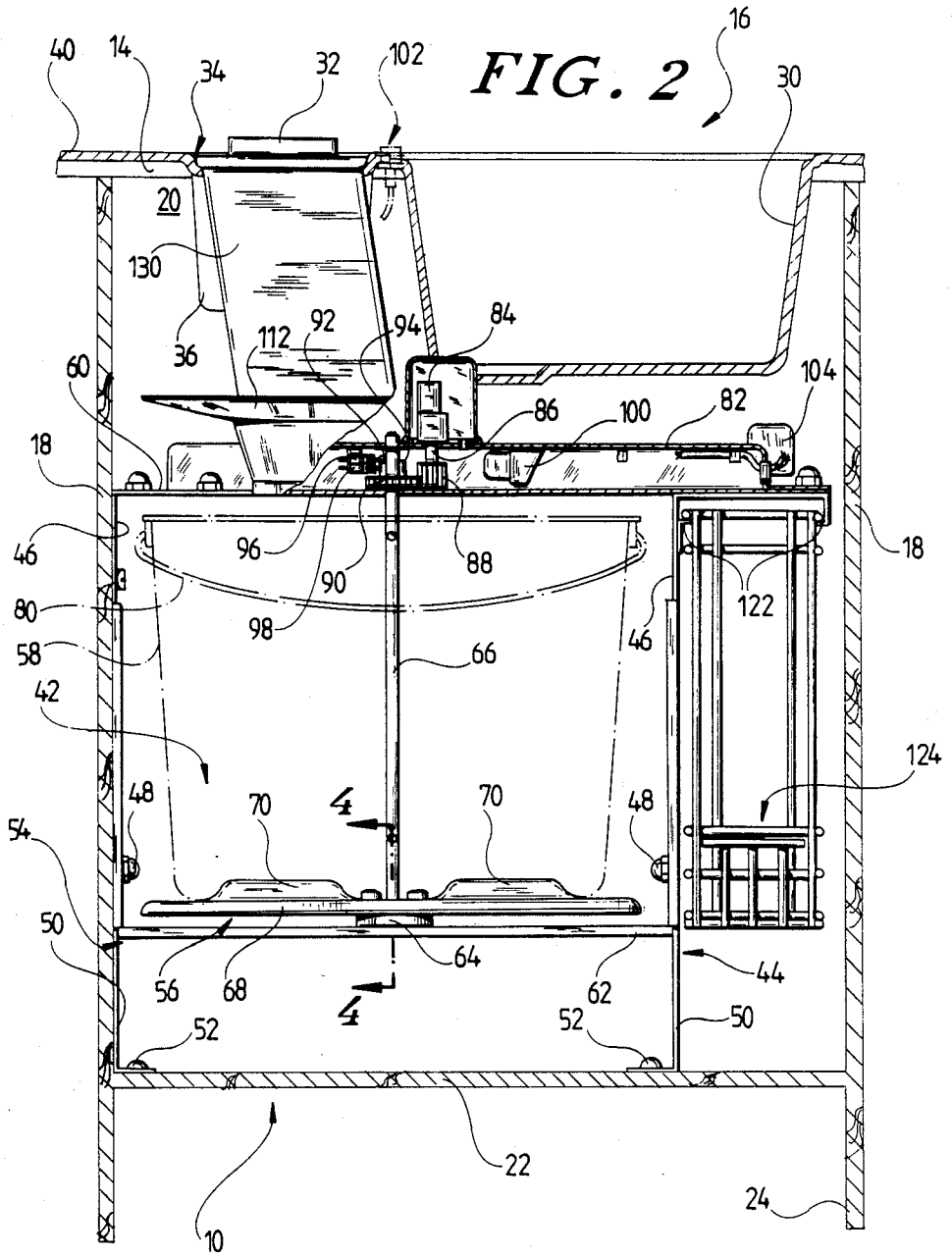
FIG. 2 is a longitudinal sectional view through the components shown in FIG. 1 parallel to the front edge of the counter top, with the waste bins of the garbage collection device indicated only in dot-and-dash lines.

As is apparent from FIG. 2, the shaft 66 extends through the cover 60 to be driven by a gearing which is covered by a box-shaped motor support 82 also shown in FIG. 1. Attached to it is a drive motor 84 in the form of a gear motor whose motor shaft 86 carries a drive pinion 88 which meshes with a gear wheel 90 attached to the shaft 66. Attached to the shaft 66 above the gear wheel are two trigger cams 92 and 94 which cooperate with limit switches 96 and 98 likewise arranged on the motor support 82. The trigger cams 92, 94, the limit switches 96, 98, a relay 100 attached to the motor support 82 and an electric switch with an intergrated indicator lamp, together designated by 102 and inserted into the top surface of the built-in sink unit 16 in the region of the front rim of the sink unit, more particularly, beside the garbage discharge opening 34, together constitute the control system for the drive motor 84 whose function will be explained in further detail below. A transformer 104 by means of which the drive motor 84 is supplied with power is mounted at the rear wall 20 of the bottom cupboard 10.

In its left region, in accordance with FIG. 1, the cover 60 of the holder 54 comprises a feed opening 110 at the front and back, in each case. In the region of the front one of these two openings, a funnel 112 is attached to the cover 60, while the rear one of the two feed openings is closed by a removable cover plate 114. This design of the cover 60 enables it to be turned through 180 degrees about its center vertical axis if a built-in sink unit is installed whose sink, viewed from the front, is located on the left of the garbage discharge opening 34. In this case, the funnel 112 and the cover plate 114 are then simply exchanged. FIG. 1 also shows a box-shaped electronic control system 120 which is arranged on the motor support 82.

Also provided on the holder 54, outside of the frame 44, are two guide rails 122 into which a further container, in the illustrated embodiment, a basket 124, can be inserted. It can accommodate cleaning agents, cloths and the like.

Inserted into the garbage discharge opening 34 from above is a garbage chute 130 which protrudes into the funnel 112 and is closed at the top by the removable cover 32.

In accordance with the invention, the control system 92, 94, 96, 98, 100, 102 is so designed that actuation of the switch 102 causes the rotatable bottom 68 to rotate (in the instant case through 180 degrees) until the next waste bin 58 comes to rest underneath the feed opening 110 of the cover 60 which is provided with the funnel 112. The limit switch 96 or 98 associated with this position then switches off the drive motor 84 and switches over the indicator lamp 102. If the rotatable bottom 68 supports only two waste bins 58, the indicator lamp integrated into the switch 102 lights up green when, for example, the waste bin provided for organic waste is below the funnel 112, whereas the indicator lamp is switched off when the waste bin provided for inorganic waste, for example, cans or bottles has been turned to the position below the funnel 112. If there are more than two waste bins, the control system has to be correspondingly designed, and the indicator integrated into the switch 102 can, for example, include several indicator elements having various colors.

Since the standard measurement of modern built-in kitchen units is 60 cm and, consequently, the distance of the side walls 18 of the bottom cupboard 10 from one another is 60 cm, in the illustrated preferred embodiment of the inventive garbage collection device, the holder 54 has a width of somewhat less than 60 cm. Depending on the design of the built-in sink unit and the location of the garbage discharge opening 34, the garbage chute 130 can extend vertically or at a slight incline.

It is recommendable to provide the rotatable bottom 68 (or another element supporting the waste bins 58) and the bottoms of the waste bins with devices, in particular, adhesive magnets and/or fixing pins and engagement channels for these to ensure that the waste bins do not tilt or slip during abrupt acceleration or braking.

What is claimed is:

1. A sink unit comprising a sink with a shaped plate within which a sink basin and beside the same a waste disposal opening are provided, said sink unit having a drop shaft stationary relative to said shaped plate and extending downwardly from said opening, and holding means for carrying at least two waste containers beneath said shaped plate, wherein said holding means comprises a waste container support movable relative to said shaped plate for selectively positioning each of said at least two waste containers below said drop shaft for loading each of said at least two waste containers with garbage through said drop shaft, and wherein actuating means for moving said waste container support are provided for positioning a selected one of said at least two waste containers below said drop shaft.

2. A sink unit as set forth in claim 1, wherein said waste container support is rotatable about a vertical axis.

3. A sink unit as set forth in claim 2, wherein said holding means comprises an exchangeable cover located above said at least two waste containers and has a feed opening for the selected one of said at least two waste containers positioned below said drop shaft.

4. A sink unit as set forth in claim 2, wherein said waste disposal opening is arranged in the front region of said sink unit such that said waste disposal opening is beside said sink basin and in front of a scraps basin, and said vertical axis of rotation of said waste container support is behind said waste disposal opening and at the most slightly laterally offset relative to it so that one of said at least two waste containers positioned below said drop shaft is arranged in front of the others of said at least two waste containers.

5. A sink unit as set forth in claim 2, wherein said at least two waste containers are all arranged at the same radial distance from said vertical axis of rotation.

6. A sink unit as set forth in claim 1, wherein said at least two waste containers are of identical design and their positions are interchangeable by moving said waste container support.

7. A sink unit as set forth in claim 1, wherein said actuating means comprises a drive for said waste container support and said drive being responsive to a control system for selecting a particular one of said at least two waste containers, with said control system being so designed that said drive is stopped when said selected waste container is positioned below the said waste disposal opening.

8. A sink unit as set forth in claim 1, wherein said holding means comprises a funnel-shaped conducting device for drips, garbage and the like dropping down through said waste disposal opening.

9. A sink unit as set forth in claim 1, including a chute extending from said waste disposal opening to a short distance beyond rims of said at least two waste containers, said chute including means which allow said chute to be lifted out of said waste disposal opening in an upwardly direction.

10. A sink unit as set forth in claim 9, wherein said chute dips into said funnel-shaped conducting device.

11. A sink unit as set forth in claim 1, wherein said holding means comprises a vertically adjustable frame for positioning on a floor of a bottom cupboard supporting said sink unit.

12. A sink unit as set forth in claim 1, including an indicator responsive to said positioning of said at least two waste containers to indicate which one of said at least two waste containers is positioned below said drop shaft.

13. A sink unit as set forth in claim 12, wherein said control system comprises means for switching on said drvie which together with said indicator is integrated into a top surface of said sink unit.

14. A sink unit as set forth in claim 13, wherein said means for switching is a switch integrated with said indicator.

15. A sink unit as set forth in claim 1, wherein the width of said holding means corresponds to the standard measurement of a built-in kitchen unit.

* * * * *